US009335660B2

(12) United States Patent
Yoshii

(10) Patent No.: US 9,335,660 B2
(45) Date of Patent: May 10, 2016

(54) DEVELOPER CASE AND IMAGE FORMING APPARATUS

(71) Applicant: KYOCERA DOCUMENT SOLUTIONS INC., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/091,047

(22) Filed: Nov. 26, 2013

(65) Prior Publication Data

US 2014/0147174 A1 May 29, 2014

(30) Foreign Application Priority Data

Nov. 29, 2012 (JP) ..... 2012-261313

(51) Int. Cl.
*G03G 15/08* (2006.01)

(52) U.S. Cl.
CPC ..... *G03G 15/0887* (2013.01); *G03G 15/0879* (2013.01)

(58) Field of Classification Search
CPC ..... G03G 15/0879; G03G 15/0887
USPC ..... 399/259
See application file for complete search history.

(56) References Cited

U.S. PATENT DOCUMENTS

| | | | | |
|---|---|---|---|---|
| 8,369,752 | B2 | 2/2013 | Furuta et al. | |
| 2005/0163537 | A1* | 7/2005 | Muramatsu et al. | 399/258 |
| 2007/0065183 | A1 | 3/2007 | Tomita | |
| 2009/0123174 | A1* | 5/2009 | Iwata et al. | 399/92 |
| 2009/0169241 | A1* | 7/2009 | Mimura | 399/106 |

FOREIGN PATENT DOCUMENTS

| | | | |
|---|---|---|---|
| JP | H11-143196 | A | 5/1999 |
| JP | 2001-183893 | A | 7/2001 |
| JP | 2002-258538 | A | 9/2002 |
| JP | 2007-086093 | A | 4/2007 |
| JP | 2007-101598 | A | 4/2007 |
| JP | 2007-133057 | A | 5/2007 |
| JP | 2011-53391 | | 3/2011 |

OTHER PUBLICATIONS

JP 11-143196 English translation, Kasahara et al., May 28, 1999.*
An Office Action issued by the Japanese Patent Office on Dec. 9, 2014. which corresponds to Japanese Patent Application No. 2012-261313 and is related to U.S. Appl. No. 14/091,047.
An Office Action issued by the Japanese Patent Office on Nov. 4, 2015. which corresponds to Japanese Patent Application No. 2015-020877 and is related to U.S. Appl. No. 14/091,047.

* cited by examiner

*Primary Examiner* — David Gray
*Assistant Examiner* — Thomas Giampaolo, II
(74) *Attorney, Agent, or Firm* — Studebaker & Brackett PC

(57) ABSTRACT

A developer case includes a case main body and a carrier tank. The case main body includes a toner containing space and a merging space. The toner containing space contains a toner. The merging space communicates to the toner containing space. The carrier tank is attachably/detachably installed to the case main body. The carrier tank includes a carrier containing space. The carrier containing space contains a carrier and communicates to the merging space. The toner conveyed from the toner containing space and the carrier conveyed from the carrier containing space are merged with each other in the merging space and discharged to an outside.

15 Claims, 10 Drawing Sheets

DEVELOPER CASE AND IMAGE FORMING APPARATUS

INCORPORATION BY REFERENCE

This application is based on and claims the benefit of priority from Japanese Patent application No. 2012-261313 filed on Nov. 29, 2012, the entire contents of which are incorporated herein by reference.

BACKGROUND

The present disclosure relates to a developer case containing a toner and a carrier and an image forming apparatus including the developer case.

An electrographic image forming apparatus uses a development device to develop an electrostatic latent image formed on a surface of a photosensitive drum or the like. As such a developing manner, one manner using a one-component developer consisting of a toner and another manner using two-component developer consisting of the toner and a carrier are known.

In a case using the two-component developer, because the carrier composing the developer in the development device is sequentially deteriorated, there is a problem that lifetime of the development device is shortened. In order to cope such a problem, a manner (called as a "trickle development") containing not only the toner, but also the carrier, in a developer case supplying the toner to the development device and supplying new carrier from the developer case to the development device at any time is known. By applying such a trickle development, the sequential deterioration of the carrier in the development device may be suppressed and prolongation of the lifetime of the development device may be actualized.

However, when the trickle development is applied, in order to intend to prevent unevenness of image density and to heighten image quality, it is important to stabilize a ratio (a mixture ratio) between the toner and carrier composing the two-component developer supplied from the developer case to the development device to the utmost. With regard to such a point, for example, in a manner filling the toner and carrier in turns to the developer case, even if the toner and carrier are agitated after the filling is completed, in a case where the agitation is insufficient, there is a possibility that the ratio between the toner and carrier composing the two-component developer supplied from the developer case to the development device becomes unstable. In addition, because the toner and carrier are filled to the same space in the developer case, if once the toner and carrier are filled to the developer case, the toner and carrier cannot be separated from each other and it is difficult to adjust again the ratio between the toner and carrier.

On the other hand, there is a configuration filling a premix toner, in which the toner and carrier are diffused in advance, to the developer case. However, in such a configuration, if the toner and carrier are not evenly diffused in the premix toner, similarly to the manner filling the toner and carrier in turns to the developer case, there is a possibility that the ratio between the toner and carrier composing the two-component developer supplied from the developer case to the development device becomes unstable.

By contrast, there is a configuration connecting a toner case and a carrier case, which are individually provided, via a tube to the development device. In this configuration, because the toner discharged from the toner case and the carrier discharged from the carrier case are mixed in the tube, the ratio between the toner and carrier composing the two-component developer supplied to the development device may become stable.

However, in this configuration, because the toner case and carrier case are individually provided, in addition to a drive source rotating rotation members (e.g. a conveying screw and an agitating paddle) provided in the toner case, another drive source rotating rotation members provided in the carrier case is needed, and accordingly, increase of manufacturing cost is caused. Moreover, because the toner case and carrier case are individually provided, a user must attach/detach individually the toner case and carrier case from the tube, and accordingly, working load of the user increases.

SUMMARY

In accordance with an embodiment of the present disclosure, a developer case includes a case main body and a carrier tank. The case main body includes a toner containing space and a merging space. The toner containing space contains a toner. The merging space communicates to the toner containing space. The carrier tank is attachably/detachably installed to the case main body. The carrier tank includes a carrier containing space. The carrier containing space contains a carrier and communicates to the merging space. The toner conveyed from the toner containing space and the carrier conveyed from the carrier containing space are merged with each other in the merging space and discharged to an outside.

In accordance with an embodiment of the present disclosure, an image forming apparatus includes a developer case. The developer case includes a case main body and a carrier tank. The case main body includes a toner containing space and a merging space. The toner containing space contains a toner. The merging space communicates to the toner containing space. The carrier tank is attachably/detachably installed to the case main body. The carrier tank includes a carrier containing space. The carrier containing space contains a carrier and communicates to the merging space. The toner conveyed from the toner containing space and the carrier conveyed from the carrier containing space are merged with each other in the merging space and discharged to an outside.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
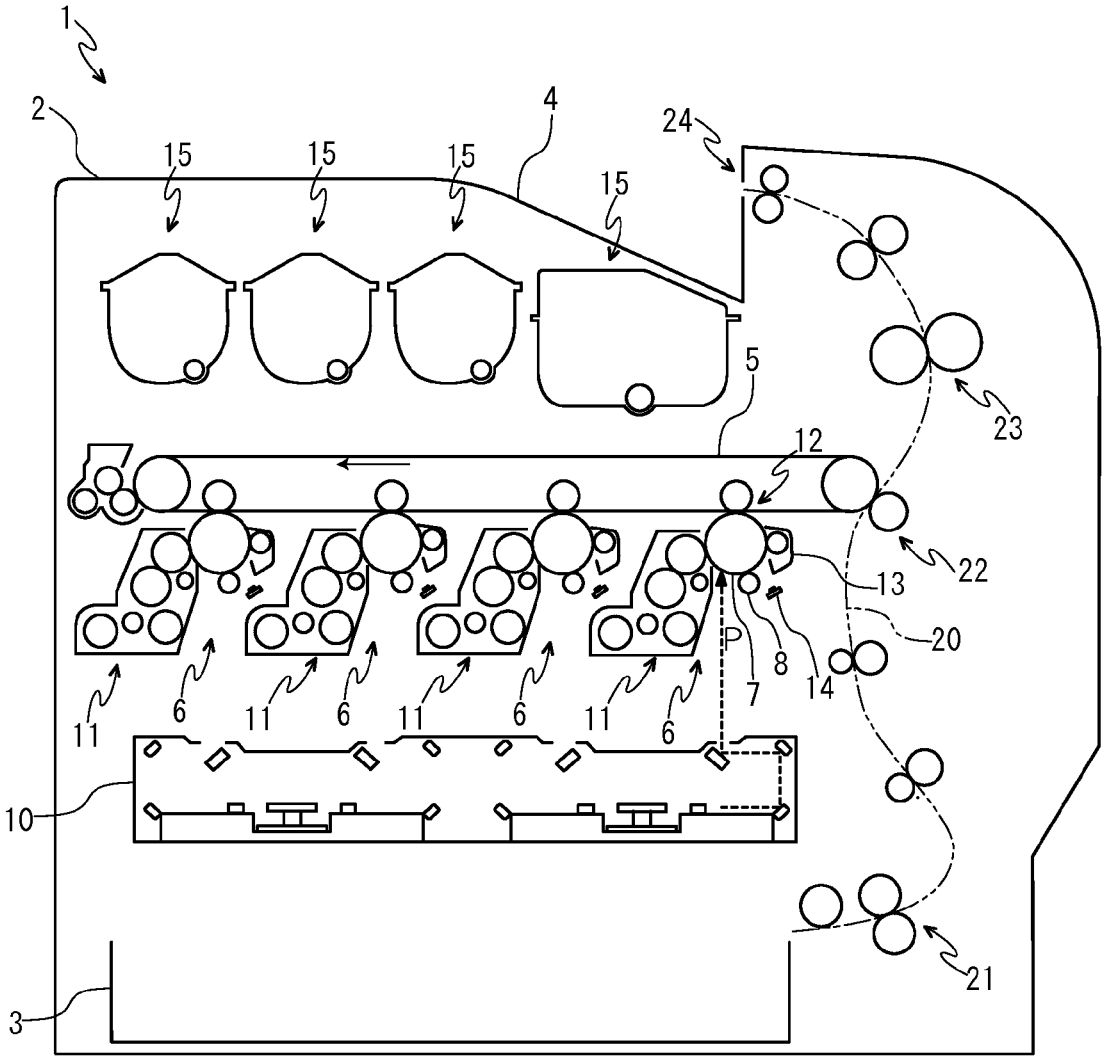
FIG. 1 is a schematic diagram schematically showing a configuration of a color printer according to an embodiment of the present disclosure.

First, with reference to FIG. 1, the entire structure of a color printer 1 (an image forming apparatus) will be described. FIG. 1 is a schematic diagram schematically showing the color printer according to an embodiment of the present disclosure.

The color printer 1 includes a box-formed printer main body 2. In a lower part of the printer main body 2, a sheet feeding cartridge 3 configured to store sheets (not shown) is installed and, in an upper end of the printer main body 2, an ejected sheet tray 4 is formed.

In an upper part of the printer main body 2, an intermediate transferring belt 5 is bridged over a plurality of rollers. Below the intermediate transferring belt 5, an exposure device 10 composed of a laser scanning unit (LSU) is located. At a downward side of the intermediate transferring belt 5, a plurality of image forming parts 6 are installed. The image forming parts 6 are arranged, for example, so as to be correspondent to respective colors of yellow (Y), cyan (C), magenta (M) and black (B). Hereinafter, one of the plurality of the image forming parts 6 will be described. In each image forming part 6, a photosensitive drum 7 (an image carrying body) is rotatably attached. Around the photosensitive drum 7, a charger 8, a development device 11, a first transferring part 12, a cleaning device 13 and a static eliminator 14 are located in order of first transfer processing. Above each development device 11, a developer case 15 is arranged.

At one side (the right-hand side on the figure) in the printer main body 2, a conveying path 20 of the sheet is arranged. At an upstream end of the conveying path 20, a sheet feeding part 21 is positioned. At an intermediate stream part of the conveying path 20, a second transferring part 22 is positioned at one end (the right end side on the figure) of the intermediate transferring belt 5. At a downstream part of the conveying path 20, a fixing part 23 is positioned and, at a downstream end of the conveying path 20, an ejection opening 24 is positioned.

Next, the operation of forming an image by the color printer 1 having such a configuration will be described.

When the power is supplied to the color printer 1, various parameters are initialized and initial determination, such as temperature determination of the fixing part 23, is carried out. Subsequently, in the color printer 1, when image data is inputted and a printing start is directed from a computer or the like connected with the color printer 1, image forming operation is carried out as follows.

First, the surface of the photosensitive drum 7 is electrically charged by the charger 8. Then, exposure corresponding to the image data on the photosensitive drum 7 is carried out by a laser (refer to an arrow P) from the exposure device 10, thereby forming an electrostatic latent image on the surface of the photosensitive drum 7. The electrostatic latent image is developed to a toner image having a correspondent color with a toner in the development device 11. The toner image is first-transferred onto the surface of the intermediate transferring belt 5 in the first transferring part 12. The above-mentioned operation is repeated in order by the respective image forming parts 6, thereby forming the toner image having full color onto the intermediate transferring belt 5. The toner and electric charge remained on the photosensitive drum 7 are eliminated by the cleaning device 13 and static eliminator 14.

On the other hand, the sheet fed from the sheet feeding cartridge 3 or a manual bypass tray (not shown) by the sheet feeding part 21 is conveyed to the second transferring part 22 in a suitable timing for the above-mentioned image forming operation. Then, in the second transferring part 22, the toner image having full color on the intermediate transferring belt 5 is second-transferred onto the sheet. The sheet with the second-transferred toner image is conveyed to a downstream side on the conveying path 20 to enter the fixing part 23, and then, the toner image is fixed on the sheet in the fixing part 23. The sheet with the fixed toner image is ejected from the ejection opening 24 onto the ejected sheet tray 4.

Next, with reference to FIGS. 2-8, the developer case 15 will be described. Arrows Fr suitably indicated in FIG. 2 or more indicate the front side of the developer case 15.

Figure 2:
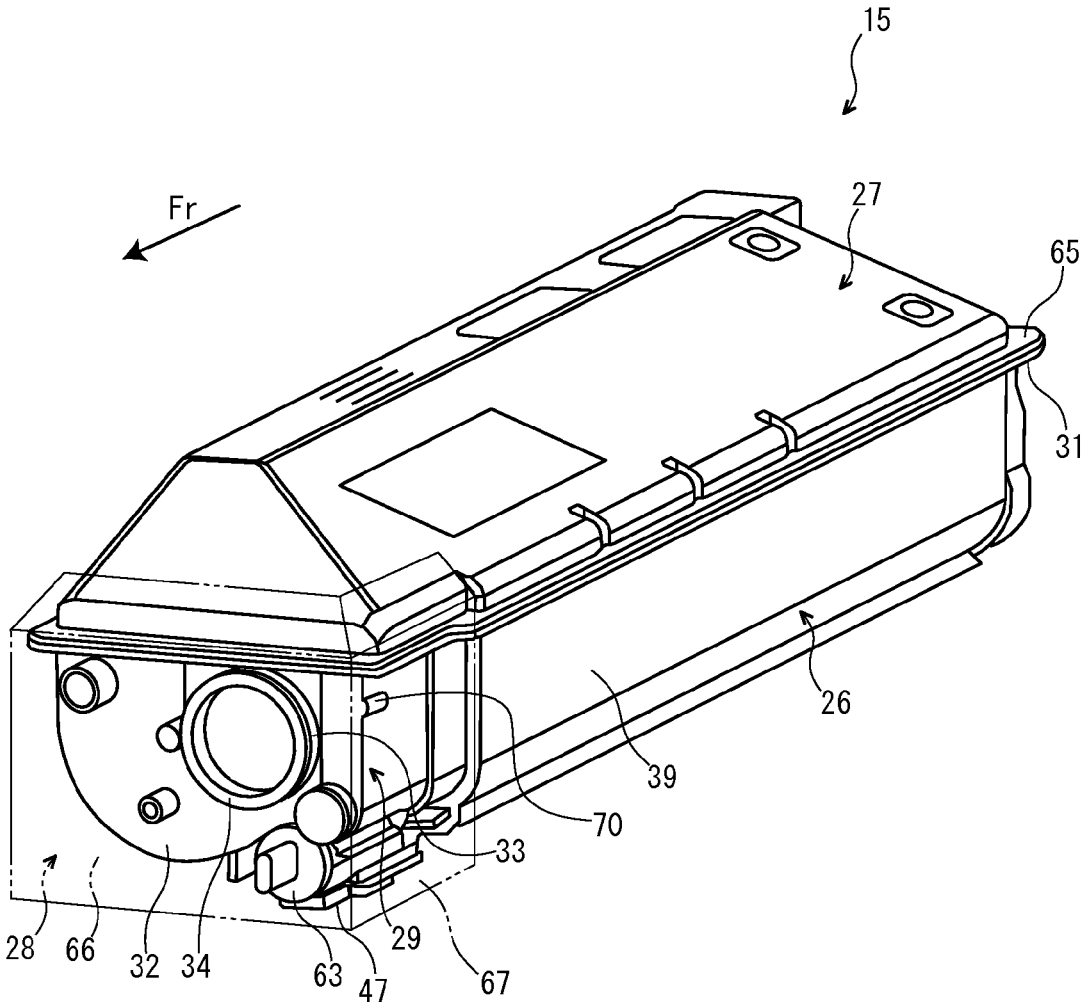
FIG. 2 is a front right perspective view showing a developer case in the color printer according to the embodiment of the present disclosure.

The developer case 15 is attachably/detachably arranged to the printer main body 2. As shown in FIG. 2, the developer case 15 includes a case main body 26, a covering body 27 covering an upper face of the case main body 26, a cover 28 attached in a front end part of the case main body 26 and a carrier tank 29 attachably/detachably installed to a right front end part of the case main body 26. Hereinafter, such components will be described in order.

First, the case main body 26 and members provided in this case main body 26 will be described. The case main body 26 is formed in an elongated shape in forward and backward directions. The case main body 26 is also formed in a box-like shape with an opening at its upper face side. On the circumference of a top end of the case main body 26, a main body side flange part 31 is formed. In a right side part of the front end wall 32 of the case main body 26, a toner filling port 33 is formed. The toner filling port 33 is closed by a toner cap 34.

Figure 3:
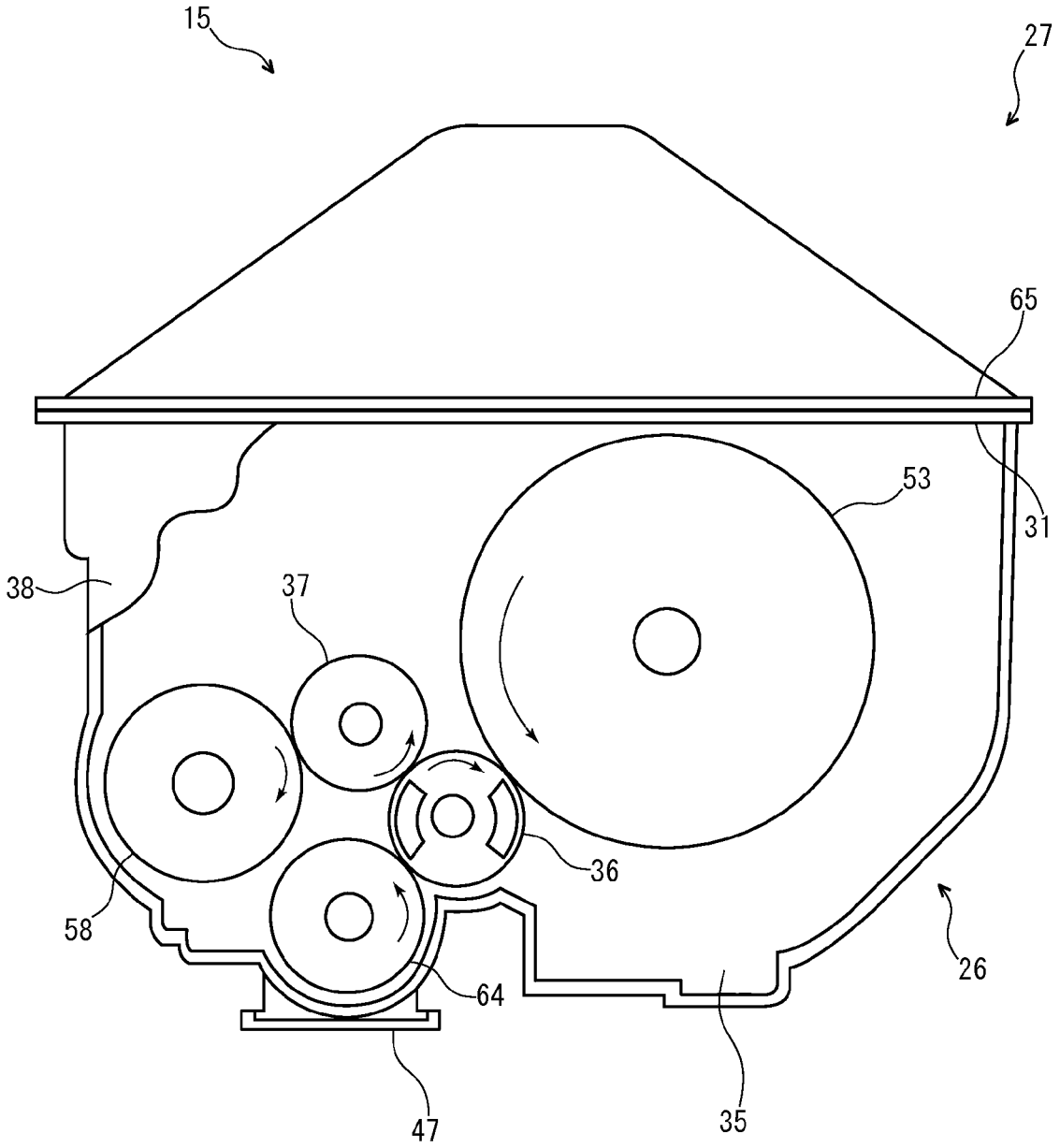
FIG. 3 is a back view showing the developer case in the color printer according to the embodiment of the present disclosure.

As shown in FIG. 3, in a right lower part (the left lower side on the figure) of a rear end wall 35 of the case main body 26, a following coupling 36 is rotatably attached. In a right side part (the left side on the figure) of the rear end wall 35 of the case main body 26, an idle gear 37 meshed with the following coupling 36 is rotatably attached. The rear end wall 35 of the case main body 26 is covered by a gear cover 38 (partially shown in FIG. 3).

Figure 4:
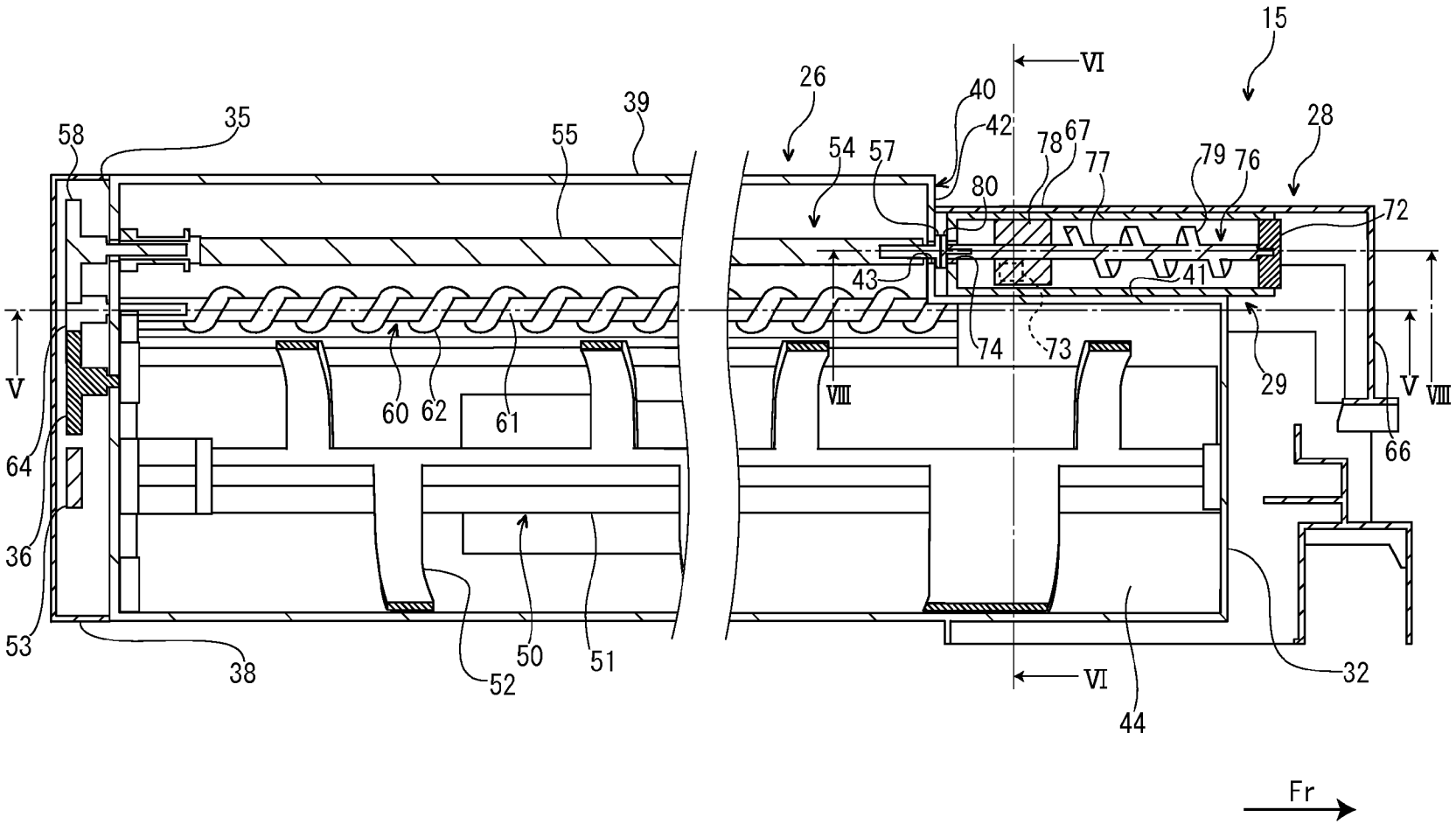
FIG. 4 is a flat sectional view showing the developer case in the color printer according to the embodiment of the present disclosure.

As shown in FIG. 4, in a right front end part of the case main body 26, an installation depressed part 40 is formed between the front end wall 32 and a right side wall 39. The installation depressed part 40 has a side face part 41 bent from a right side part of the front end wall 32 of the case main body 26 to a backward side and a back face part 42 bent from a rear end of the side face part 41 to a right side and connected to the right side wall 39 of the case main body 26. In the back face part 42, a communication hole 43 is bored in the forward and backward directions.

Figure 5:
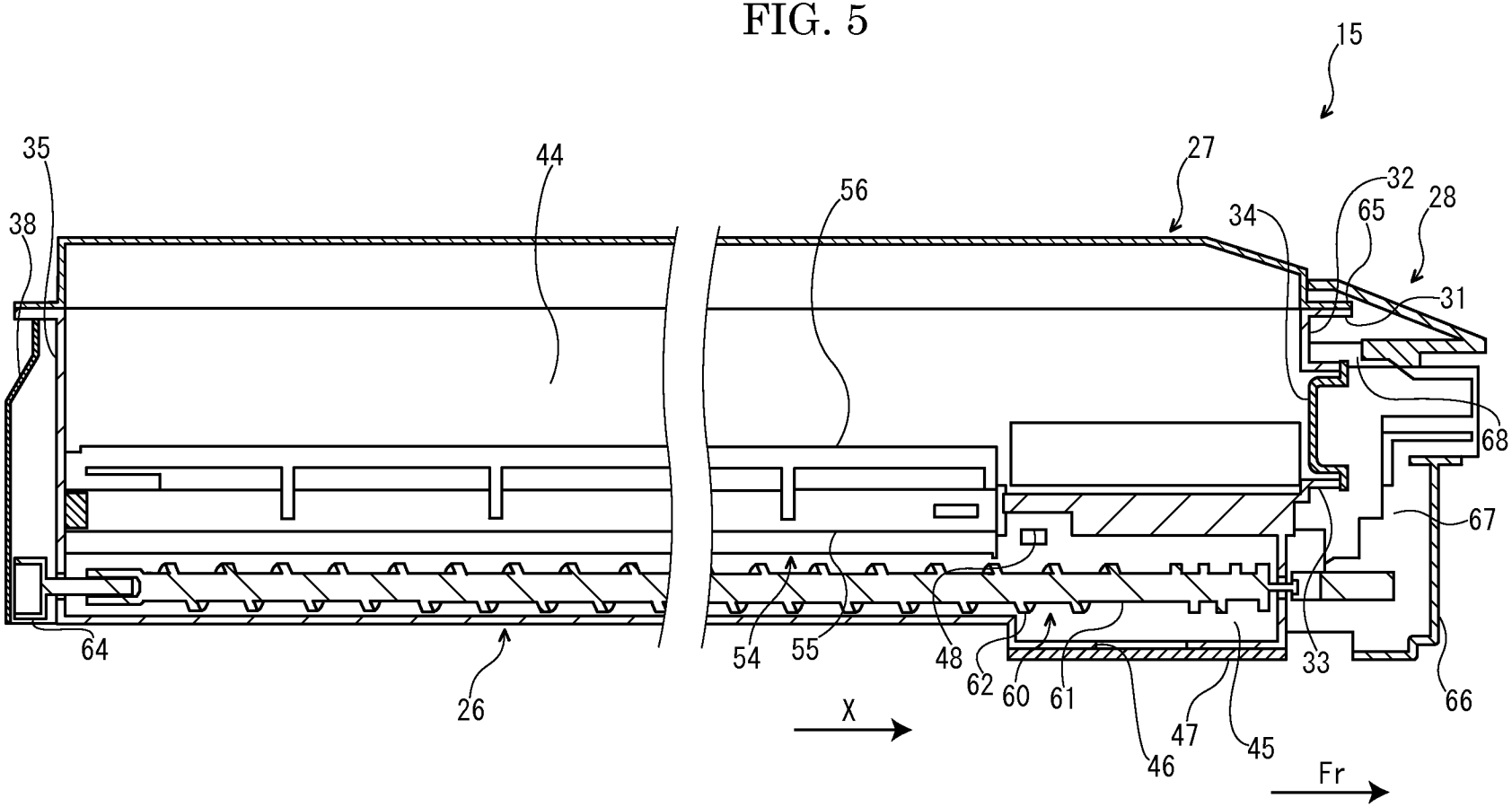
FIG. 5 is a sectional view along a line V-V shown in FIG. 4.
Figure 6:
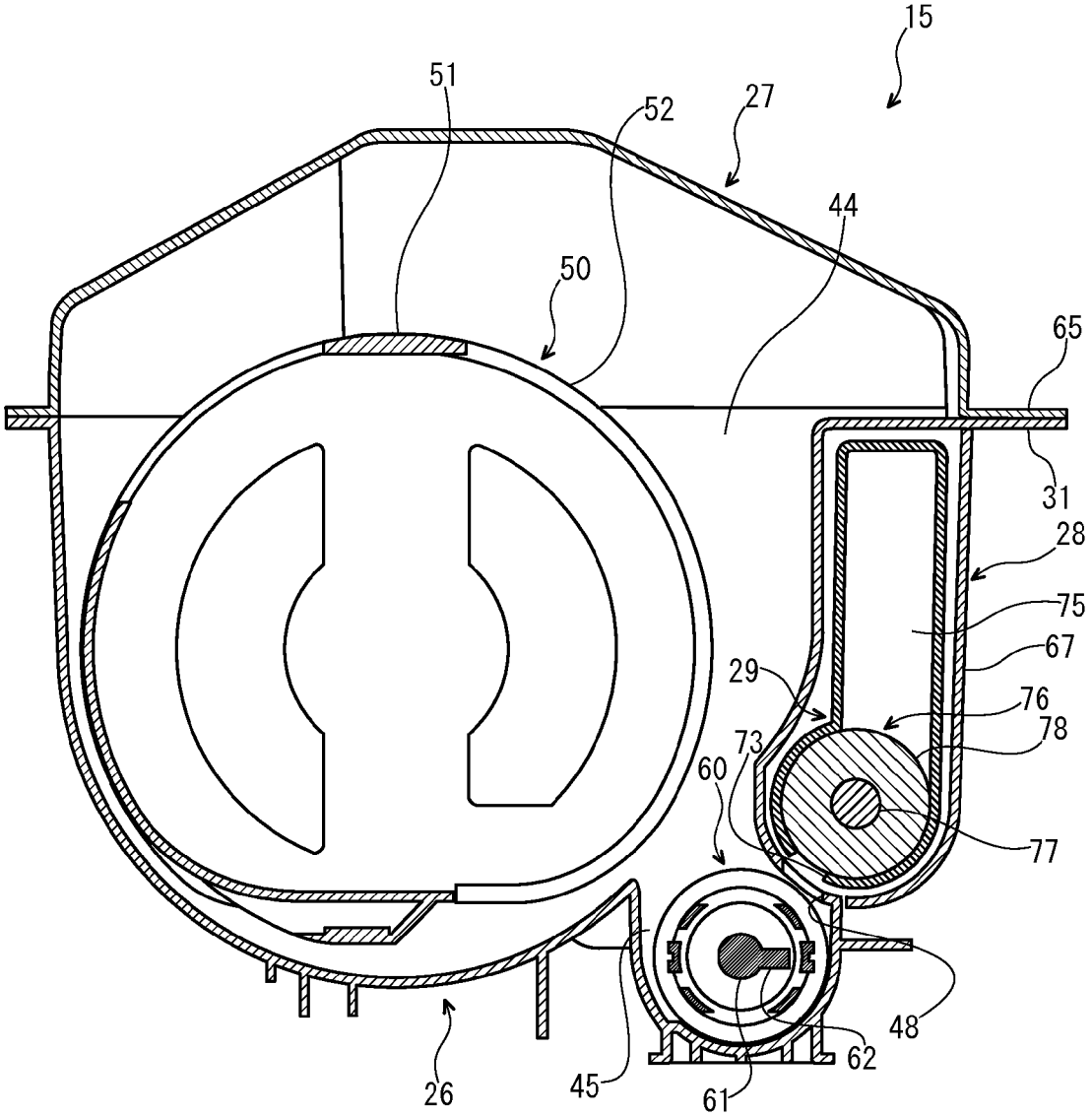
FIG. 6 is a sectional view along a line VI-VI shown in FIG. 4.

Inside the case main body 26, a toner containing space 44 is arranged and, in the toner containing space 44, the toner, such as a magnetic toner, is contained. As shown in FIGS. 5 and 6, inside the case main body 26, at a right downward side of a front end part of the toner containing space 44, a merging space 45 is arranged. A rear side and a left upper side of the merging space 45 are communicated to the toner containing space 44. In the case main body 26, at a lower side of the merging space 45, a developer discharging port 46 is formed.

A lower side of the developer discharging port 46 is openably/closably covered by a slidable shutter 47. Accompanying to attaching operation of the developer case 15 to the printer main body 2, the shutter 47 opens the developer discharging port 46. In the case main body 26, at a right upper side of the merging space 45, a carrier introducing port 48 is formed. The carrier introducing port 48 is located at the backward side from the developer discharging port 46 and arranged adjacent to the developer discharging port 46.

As shown in FIG. 4, in the case main body 26, a first agitating paddle 50 is rotatably attached. The first agitating paddle 50 is installed at a section from a left end part to a right side part in the toner containing space 44 and formed in an elongated shape in the forward and backward directions. The first agitating paddle 50 includes a supporting frame 51 extending in the forward and backward directions and an agitating vane 52 attached to the supporting frame 51. A front end part of the supporting frame 51 is pivotally supported by the front end wall 32 of the case main body 26. A rear end part of the supporting frame 51 penetrates the rear end wall 35 of the case main body 26 so as to protrude from the rear end wall 35 of the case main body 26 to the backward side (an outside) and, to such a protruding part, a first agitation gear 53 is attached. The first agitation gear 53 is meshed with the following coupling 36 (refer to FIG. 3).

As shown in FIG. 4, in the case main body 26, at a right side of the first agitating paddle 50, a second agitating paddle 54 (an agitating member) is rotatably attached. The second agitating paddle 54 is installed in a right end part of the toner containing space 44 and formed in an elongated shape in the forward and backward directions. The second agitating paddle 54 includes an axis part 55 extending in the forward and backward directions and an agitating part 56 attached to the axis part 55 (refer to FIG. 5).

As shown in FIG. 4, a front end part of the axis part 55 penetrates the communication hole 43 formed in the back face part 42 of the installation depressed part 40 in the case main body 26 so as to protrude from the back face part 42 to a forward side (the outside) and, to such a protruding part, a main body side joint part 57 is attached. The main body side joint part 57 is exposed to the outside of the case main body 26. A rear end part of the axis part 55 penetrates the rear end wall 35 of the case main body 26 so as to protrude from the rear end wall 35 of the case main body 26 to the backward side (the outside) and, to such a protruding part, a second agitation gear 58 is attached. The second agitation gear 58 is meshed with the idle gear 37 (refer to FIG. 3).

As shown in FIGS. 4 and 6, in the case main body 26, between the first agitating paddle 50 and second agitating paddle 54, at a position lower than the first agitating paddle 50 and second agitating paddle 54, a main body side conveying screw 60 (a main body side conveying member) is rotatably attached. A section from a front part to a rear part in the main body side conveying screw 60 is installed in the toner containing space 44 of the case main body 26. A front end part of the main body side conveying screw 60 is installed in the merging space 45 of the case main body 26.

The main body side conveying screw 60 includes a screw axis 61 extending in the forward and backward directions and a spiral fin 62 arranged on the circumference of the screw axis 61. A front end part of the screw axis 61 is pivotally supported by a bearing part 63 (refer to FIG. 2) arranged at a right lower side of the front end wall 32 of the case main body 26. A rear end part of the screw axis 61 penetrates the rear end wall 35 of the case main body 26 so as to protrude from the rear end wall 35 of the case main body 26 to the backward side (the outside) and, to such a protruding part, a conveyance gear 64 is attached. The conveyance gear 64 is meshed with the following coupling 36 (refer to FIG. 3).

Next, the covering body 27 will be described. As shown in FIG. 2, the covering body 27 is formed in an elongated shape in the forward and backward directions. In a lower end of the covering body 27, a covering body side flange part 65 is formed in a corresponding shape to the main body side flange part 31 of the case main body 26. The main body side flange 31 and covering body side flange 65 are ultrasonic-welded together so that the case main body 26 and covering body 27 are unified.

Next, the cover 28 will be described. The cover 28 includes a front face board 66 covering the front end wall 32 of the case main body 26 and a side face board 67 bent from the front face board 66 to the backward side. In an upper part of a left face (an inside face) of the side face board 67, an engagement groove 68 is formed (refer to FIG. 5).

Next, the carrier tank 29 will be described. As shown in FIG. 4, the carrier tank 29 is inserted to the installation depressed part 40 of the case main body 26. The carrier tank 29 is held so as to be interposed between the side face part 41 of the installation depressed part 40 of the case main body 26 and side face board 67 of the cover 28.

Figure 7:
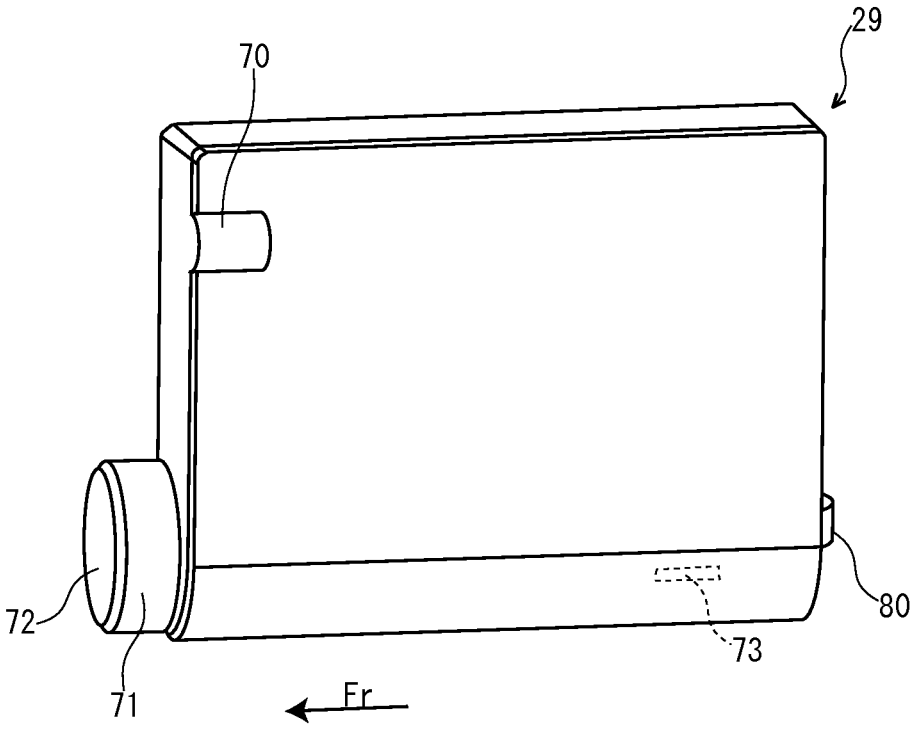
FIG. 7 is a perspective view showing a carrier tank in the developer case of the color printer according to the embodiment of the present disclosure.

As shown in FIG. 7, the carrier tank 29 is formed in a flat shape elongated in the forward and backward directions and in upward and downward directions. In a front upper part of a right side face of the carrier tank 29, an engaging projection 70 is projected. In a lower end part of a front face of the carrier tank 29, a cylinder-like fixed pipe part 71 is projected. A front end part of the fixed pipe part 71 is closed by a cap 72. In a back face of the carrier tank 29, an insertion hole 74 is formed (refer to FIG. 4).

As shown in FIG. 6, inside the carrier tank 29, a carrier containing space 75 containing the carrier is arranged. A filling amount of the carrier in the carrier containing space 75 is, for example, 3-10% of a filling amount of the toner in the toner containing space 44, that is, less than the filling amount of the toner in the toner containing space 44. Therefore, a capacity of the carrier containing space 75 is smaller than a capacity of the toner containing space 44. A ratio of the filling amount of the carrier in the carrier containing space 75 to the filling amount of the toner in the toner containing space 44 may be changed suitably according to machine type, for example, so as to be determined as 6% for a high speed machine (a high order machine) or as 3% for a low speed machine (a low order machine). In addition, type of the carrier contained in the carrier containing space 75 may be changed suitably according to the machine type.

In a left lower side of a rear part of the carrier tank 29, a carrier discharging port 73 is formed. Via this carrier discharging port 73 and carrier introducing port 48 of the case main body 26, the carrier containing space 75 and merging space 45 of the case main body 26 are communicated to each other.

Figure 8:
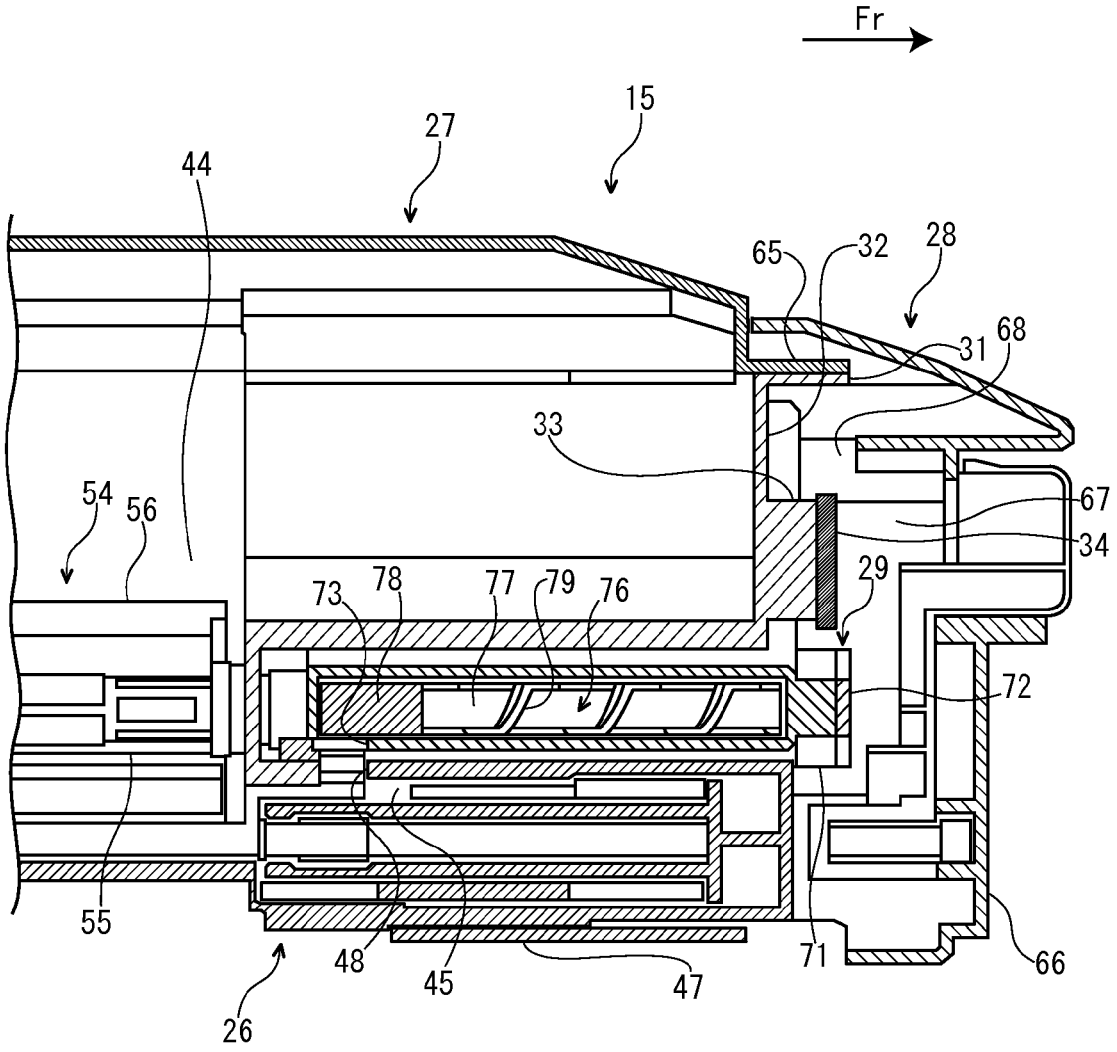
FIG. 8 is a sectional view along a line VIII-VIII shown in FIG. 4.

In a lower end part of the carrier tank 29, a tank side conveying screw 76 (a tank side conveying member) is rotatably attached. As shown in FIG. 8, the tank side conveying screw 76 includes a rotation axis 77, a porous body 78 arranged on the circumference of a rear end part in the rotation axis 77 and a fin 79 arranged on the circumference of a section from a front end part to a rear part in the rotation axis 77.

The rotation axis 77 extends in the forward and backward directions. The front end part of the rotation axis 77 is pivotally supported by the cap 72 closing the fixed pipe part 71 of the carrier tank 29. As shown in FIG. 4, the rear end part of the rotation axis 77 penetrates the insertion hole 74 of the carrier tank 29 so as to protrude from the back face of the carrier tank 29 to the backward side and, to such a protruding part, a tank side joint part 80 is attached. The tank side joint part 80 is exposed to the outside of the carrier tank 29. The tank side joint part 80 is connected to the main body side joint part 57 arranged in the second agitating paddle 54.

The porous body 78 is composed of, for example, a sponge. As shown in FIG. 6 and others, the porous body 78 is formed in a cylinder-like shape. The porous body 78 covers the carrier discharging port 73 arranged in the carrier tank 29.

Subsequently, a configuration of the development device 11 will be described with reference to FIGS. 9 and 10.

The development device 11 includes a casing 81 having a box-like shape. Inside the casing 81, a two-component developer consisting of the toner and carrier is contained. The casing 81 is formed in an elongated shape in the forward and backward directions (in a depth direction on a paper of FIG. 9). In a lower part of the casing 81, a developer containing part 82 is arranged.

At a center of the developer containing part 82, a roughly U-shaped partition 83 is attached. At a left side, a right side and an upper side of the partition 83, a first screw 84, a second screw 85 and a third screw 86 are rotatably attached. By the screws 84-86, the developer in the developer containing part 82 is circulated. In the developer containing part 82, a toner density detecting part (not shown) is arranged to detect toner density in the developer.

Figure 10:
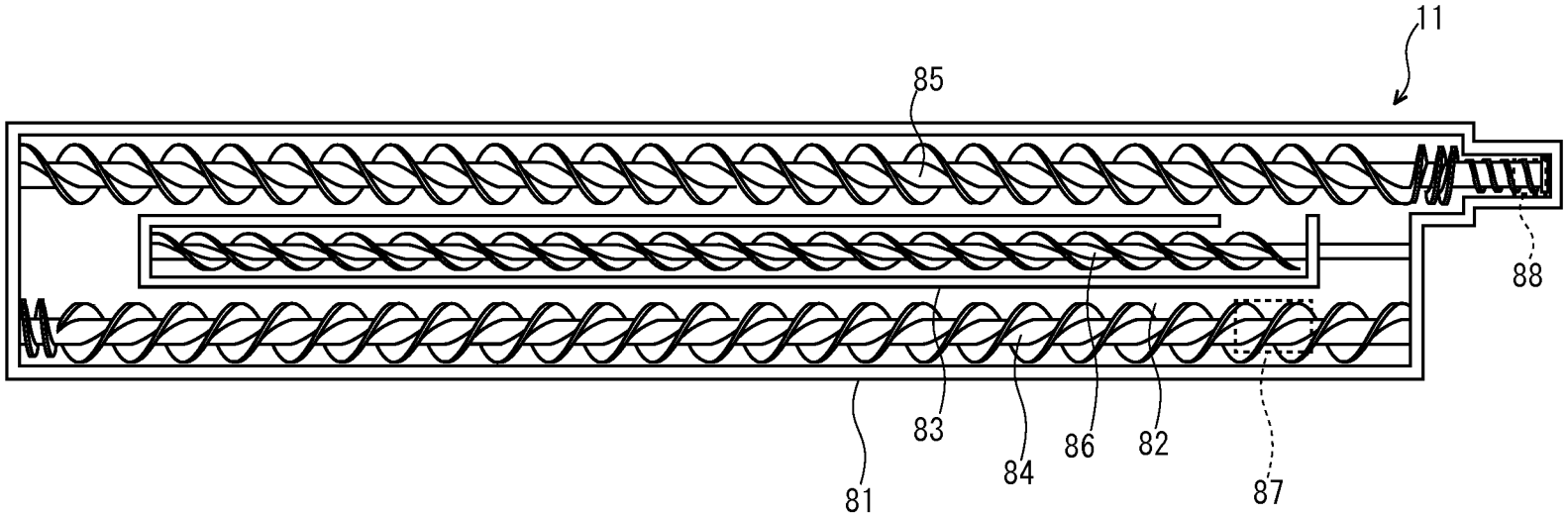
FIG. 10 is a schematic diagram used in explanation of a configuration of a developer containing part in the development device of the color printer according to the embodiment of the present disclosure.

As shown in FIG. 10, in the developer containing part 82, at one end side in a longitudinal direction in a section installing the first screw 84, a developer replenishing port 87 is arranged. Via the developer replenishing port 87, the two-component developer supplied from the developer case 15 can be introduced in the developer containing part 82. In the developer containing part 82, at one end side in a longitudinal direction in a section installing the second screw 85, a redundant developer discharging port 88 is arranged. Via the redundant developer discharging port 88, overflowed developer can be discharged from the developer containing part 82.

Figure 9:
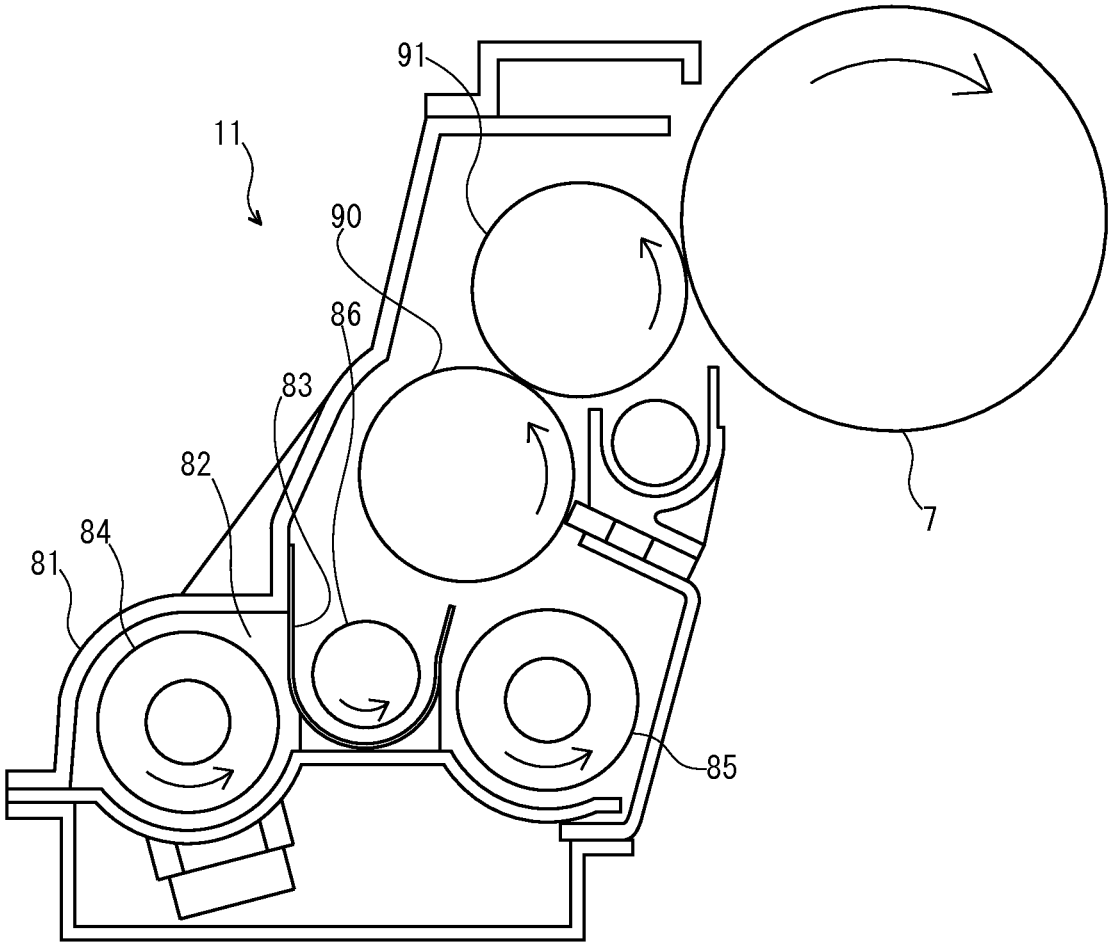
FIG. 9 is a schematic diagram used in explanation of a configuration of a development device in the color printer according to the embodiment of the present disclosure.

As shown in FIG. 9, at a center part in the upward and downward directions of the casing 81, a magnetic roller 90 is rotatably attached. The magnetic roller 90 is located at a left upper side of the second screw 85 so that the two-component developer is supplied from the second screw 85 to the magnetic roller 90.

In an upper part of the casing 81, a developing roller 91 (a toner carrying body) is rotatably attached. The developing roller 91 is located at a right upper side of the magnetic roller 90 and faced to the magnetic roller at a predetermined distance. The two-component developer is supplied from the magnetic roller 90 to the developing roller 91. The developing roller 91 comes into contact with or comes adjacent to the photosensitive drum 7 so that the two-component developer is supplied from the developing roller 91 to the photosensitive drum 7, and accordingly, the electrostatic latent image being carried on the photosensitive drum 7 is developed. As mentioned above, the development device 11 according to the embodiment carries out development process by using the two-component developer.

In the developer case 15 configured as mentioned above, in order to attach the carrier tank 29 to the case main body 26, the carrier tank 29 is inserted to the installation depressed part 40 of the case main body 26. In addition, the engagement groove 68 (refer to FIG. 5) of the cover 28 is engaged with the engaging projection 70 (refer to FIG. 7) of the carrier tank 29, and simultaneously, the cover 28 is attached to the front end part of the case main body 26. According to this, the carrier tank 29 is held so as to be interposed between the side face part 41 of the installation depressed part 40 of the case main body 26 and side face board 67 of the cover (refer to FIG. 4). In the embodiment, it is thus possible to attach the carrier tank 29 to the case main body 26 by applying a simple configuration. Incidentally, detachment of the carrier tank 29 from the case main body 26 can be achieved by detaching the cover 28, and then, detaching the carrier tank 29 from the installation depressed part 40 of the case main body 26.

When the carrier tank 29 is attached to the case main body 26 as mentioned above, the main body side joint part 57 arranged in the second agitating paddle 54 and the tank side joint part 80 arranged in the tank side conveying screw 76 are connected to each other so that the tank side conveying screw 76 becomes rotatable integrally with the second agitating paddle 54.

Moreover, in order to supply the two-component developer from the developer case 15 configured as mentioned above to the development device 11, the developer case 15 is attached to the printer main body 2. Accompanying to this, the following coupling 36 (refer to FIG. 3) of the developer case 15 is connected to a drive coupling (not shown) provided in the printer main body 2. In such a situation, if a drive source (not shown), such as a motor, connected to the drive coupling is rotated, this rotation is transmitted via the drive coupling to the following coupling 36, and then, the following coupling 36 is rotated in one direction (in a clockwise direction in a back view, refer to FIG. 3). When the following coupling 36 is thus rotated in the one direction, the idle gear 37, first agitation gear 53 and conveyance gear 64 meshed with the following coupling 36 are rotated in another direction (in a counterclockwise direction in a back view, refer to FIG. 3). In addition, the second agitation gear 58 meshed with the idle gear 37 is rotated in the one direction.

When the first agitation gear 53 is rotated in the other direction as mentioned above, the first agitating paddle 50 is rotated in the other direction. When the second agitation gear 58 is rotated in the one direction as mentioned above, the second agitating paddle 54 is rotated in the one direction. Thus, when the first agitation paddle 50 and second agitation paddle 54 are rotated, accompanying to this, the toner contained in the toner containing space 44 of the case main body 26 is agitated, and simultaneously, conveyed to the main body side conveying screw 60's side.

When the conveyance gear 64 is rotated in the other direction as mentioned above, the main body side conveying screw 60 is rotated in the other direction. Accompanying to this, the toner contained in the toner containing space 44 is conveyed from the toner containing space 44 to the merging space 45. At this moment, a direction conveying the toner by the main body side conveying screw 60 is a direction running from the backward side to the forward side (refer to an arrow X in FIG. 5).

When the second agitating paddle 54 is rotated in the one direction as mentioned above, the tank side conveying screw 76 connected to the second agitating paddle 54 is rotated. When the tank side conveying screw 76 is thus rotated, the carrier in the carrier tank 29 is conveyed from the forward side to the backward side by the fin 79 of the tank side conveying screw 76 and held by the porous body 78 of the tank side conveying screw 76. The carrier thus held by the porous body 78 is discharged from the carrier discharging port 73 accompanying to the rotation of the tank side conveying screw 76 and introduced via the carrier introducing port 48 in the merging space 45.

The carrier conveyed from the carrier containing space 75 to the merging space 45 by the tank side conveying screw 76 as mentioned above is merged and mixed, in the merging space 45, with the toner conveyed from the toner containing space 44 to the merging space 45 by the main body side conveying screw 60. According to this, the two-component developer consisting of the toner and carrier is formed. This two-component developer is discharged from the developer discharging port 46 to the outside of the developer case 15 by the main body side conveying screw 60. The two-component developer thus discharged from the developer discharging port 46 is introduced via the developer replenishing port 87 in the developer containing part 82 of the development device 11.

In the developer case 15 according to the embodiment, as mentioned above, the toner conveyed from the toner containing space 44 and carrier conveyed from the carrier containing space 75 are merged with each other in the merging space 45, the two-component developer consisting of the toner and carrier is formed and this two-component developer is discharged from the merging space 45 to the outside. Because of this, certain amounts of the toner and carrier can be merged in the merging space 45, and then, discharged from the merging space 45 to the outside, and therefore, it is possible to stabilize the ratio of the toner and carrier in the two-component developer discharged from the developer case 15. According to this, it is possible to prevent unevenness of image density and to heighten image quality.

Because the carrier tank 29 is attached to the case main body 26, it is unnecessary to attach/detach individually the carrier tank 29 and case main body 26 to the development device 11 or the others, and therefore, it is possible to decrease working load of the user.

Because the carrier tank 29 is attachable and detachable to the case main body 26, it is possible to change type and amount of the carrier filled to the carrier tank 29 in accordance with the machine type or a use of the color printer 1, and therefore, to easily cope with various machine types and uses. For example, in a case of the machine type, such as the high speed machine, strongly requiring lifetime prolongation, the amount of the carrier in the carrier tank 29 is increased, while, in a case of the machine type, such as the low speed machine, strongly requiring cost reduction, the amount of the carrier in the carrier tank 29 is decreased. According to this, because it is possible to cope with both the machine type strongly requiring the lifetime prolongation and the machine type strongly requiring cost reduction by changing the specification of the carrier tank 29, it is possible to communize the case main body 26 to various machine types.

Because the carrier tank 29 and case main body 26 are attachable and detachable, it is possible to facilitate management of the developer case 15 and to recycle individually the case main body 26 and carrier tank 29.

Because the toner and carrier are filled to individual spaces (the toner containing space 44 and carrier containing space 75) in the developer case 15, if once the toner and carrier are filled to the developer case 15, it is possible to adjust again the ratio between the toner and carrier as necessary.

In the case main body 26 and carrier tank 29, the main body side conveying screw 60 and tank side conveying screw 76 are respectively arranged. Therefore, it is possible to securely convey the toner contained in the toner containing space 44 and the carrier contained in the carrier containing space 75 to the merging space 45 and to securely discharge, from the merging space 45, the two-component developer formed by merging the toner and carrier in the merging space 45.

When the carrier tank 29 is attached to the case main body 26, the main body side joint part 57 and tank side joint part 80 are connected to each other so that the tank side conveying screw 76 becomes rotatable integrally with the second agitating paddle 54. Therefore, without arranging an exclusive drive source for rotating the tank side conveying screw 76, it is possible to rotate the tank side conveying screw 76 by the drive source for rotating the second agitating paddle 54. According to this, it is possible to decrease manufacturing cost.

In the embodiment, particularly, it is configured to simultaneously rotate, by single drive source, all rotation members (the first agitating paddle 50, second agitating paddle 54, main body side conveying screw 60 and tank side conveying screw 76) arranged in the case main body 26 and carrier tank 29. Therefore, it is possible to actualize further cost reduction.

The carrier introducing port 48 is located at the upstream side from the developer discharging port 46 in the direction conveying the toner by the main body side conveying screw 60 (in the direction running from the backward side to the forward side in the embodiment, refer to the arrow X in FIG. 5) and arranged adjacent to the developer discharging port 46. By applying such a configuration, it is possible to merge the carrier with the toner immediately before the two-component developer is discharged from the developer discharging port 46. According to this, it is possible to further stable the ratio of the toner and carrier in the two-component developer discharged from the developer case 15.

When the tank side conveying screw 76 is rotated, the carrier held by the porous body 78 is discharged from the carrier discharging port 73. By applying such a configuration, it is possible to discharge the carrier contained in the carrier containing space 75 little by little from the carrier discharging port 73. Therefore, it is possible to prevent disadvantage that the carrier runs out from the carrier containing space 75 in spite of sufficiently remaining the toner in the toner containing space 44.

Although, in the embodiment, a case of connecting the tank side conveying screw 76 to the second agitating paddle 54 arranged in the case main body 26 was described, in another embodiment, the tank side conveying screw 76 may be connected to the first agitating paddle 50 or the main body side conveying screw 60. Even in such a case, it is possible to reduce the number of drive sources and to decrease the cost.

Although, in the embodiment, a case of locating the carrier introducing port 48 at the upstream side from the developer discharging port 46 in the direction conveying the toner by the main body side conveying screw was described, the arrangement of the carrier introducing port 48 is not restricted by this. For example, in another embodiment, the carrier introducing port 48 may be located just above the developer discharging port 46.

In the embodiment, a case of arranging two agitating members in the case main body 26 (refer to the "first agitating paddle 50" and "second agitating paddle 54") was described. On the other hand, in another embodiment, one agitating member or a plurality of agitating members, e.g. three or more agitating members, may be arranged in the case main body 26. In a further embodiment, no agitating member may be arranged in the case main body 26.

Although the embodiment was described in a case where the configuration of the present disclosure are applied to the color printer 1, another embodiment may apply the configuration of the disclosure to another image forming apparatus, such as a monochrome printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A developer case comprising:

a case main body configured to include a toner containing space containing a toner and a merging space communicating to the toner containing space;

a carrier tank attachably/detachably installed to the case main body and configured to include a carrier containing space containing a carrier and communicating to the merging space;

a main body side conveying member rotatably arranged in the case main body and configured to convey the toner from the toner containing space to the merging space and to discharge the toner and carrier from the merging space to an outside;

a tank side conveying member rotatably arranged in the carrier tank and configured to convey the carrier from the carrier containing space to the merging space; and an agitating member rotatably arranged in the case main body and configured to agitate the toner contained in the toner containing space, wherein the agitating member includes a main body side joint part exposed to the outside from the case main body, the tank side conveying member includes a tank side joint part exposed to the outside from the carrier tank, and when the carrier tank is attached to the case main body, the main body side joint part and tank side joint part are connected to each other so that the tank side conveying member becomes rotatable integrally with the agitating member, and the toner conveyed from the toner containing space and the carrier conveyed from the carrier containing space are merged with each other in the merging space and discharged to the outside.

2. The developer case according to claim 1, wherein the case main body includes:

a carrier introducing port introducing the carrier in the merging space; and a developer discharging port discharging the toner and carrier from the merging space to the outside, and the carrier introducing port is located at an upstream side from the developer discharging port in a direction conveying the toner by the main body side conveying member and arranged adjacent to the developer discharging port.

3. The developer case according to claim 1, wherein the carrier tank includes a carrier discharging port discharging the carrier from the carrier containing space, the tank side conveying member includes:

a rotation axis; and a porous body arranged on the circumference of the rotation axis to cover the carrier discharging port, and when the tank side conveying member is rotated, the carrier held by the porous body is discharged from the carrier discharging port.

4. The developer case according to claim 1 further comprising:

a cover attached to the case main body, wherein the carrier tank is held so as to be interposed between the case main body and cover.

5. The developer case according to claim 4, wherein the cover includes an engagement groove, and the carrier tank includes an engaging projection engaging with the engagement groove.

6. The developer case according to claim 1, wherein the case main body includes an installation depressed part, and the carrier tank is inserted to the installation depressed part.

7. The developer case according to claim 1, wherein a two-component developer consisting of the toner and carrier is formed in the merging space.

8. An image forming apparatus comprising:

a developer case, wherein the developer case includes a case main body configured to include a toner containing space containing a toner and a merging space communicating to the toner containing space;

a carrier tank attachably/detachably installed to the case main body and configured to include a carrier containing space containing a carrier and communicating to the merging space;

a main body side conveying member rotatably arranged in the case main body and configured to convey the toner from the toner containing space to the merging space and to discharge the toner and carrier from the merging space to an outside;

a tank side conveying member rotatably arranged in the carrier tank and configured to convey the carrier from the carrier containing space to the merging space; and an agitating member rotatably arranged in the case main body and configured to agitate the toner contained in the toner containing space, wherein the agitating member includes a main body side joint part exposed to the outside from the case main body, the tank side conveying member includes a tank side joint part exposed to the outside from the carrier tank, and when the carrier tank is attached to the case main body, the main body side joint part and tank side joint part are connected to each other so that the tank side conveying member becomes rotatable integrally with the agitating member, wherein the toner conveyed from the toner containing space and the carrier conveyed from the carrier containing space are merged with each other in the merging space and discharged to the outside.

9. The image forming apparatus according to claim 8 further comprising:

a development device including a developer containing part to which the toner and carrier discharged from the developer case are introduced, and a toner carrying body supplying an image carrying body with the toner introduced to the developer containing part.

10. The image forming apparatus according to claim 8, wherein the case main body includes:

a carrier introducing port introducing the carrier in the merging space; and a developer discharging port discharging the toner and carrier from the merging space to the outside, and the carrier introducing port is located at an upstream side from the developer discharging port in a direction conveying the toner by the main body side conveying member and arranged adjacent to the developer discharging port.

11. The image forming apparatus according to claim 8, wherein the carrier tank includes a carrier discharging port discharging the carrier from the carrier containing space, the tank side conveying member includes:

a rotation axis; and a porous body arranged on the circumference of the rotation axis to cover the carrier discharging port, and when the tank side conveying member is rotated, the carrier held by the porous body is discharged from the carrier discharging port.

12. The image forming apparatus according to claim 8, wherein the developer case further includes:

a cover attached to the case main body, wherein the carrier tank is held so as to be interposed between the case main body and cover.

13. The image forming apparatus according to claim 12, wherein the cover includes an engagement groove, and the carrier tank includes an engaging projection engaging with the engagement groove.

14. The image forming apparatus according to claim 8, wherein the case main body includes an installation depressed part, and the carrier tank is inserted to the installation depressed part.

15. The image forming apparatus according to claim 8, wherein a two-component developer consisting of the toner and carrier is formed in the merging space.

* * * * *